United States Patent [19]

Burke et al.

[11] Patent Number: 4,554,025

[45] Date of Patent: Nov. 19, 1985

[54] METHOD OF REMOVING BUILT-UP LAYERS OF ORGANIC COATINGS

[75] Inventors: Thomas W. Burke, Allentown; Robert A. Welch; Kevin S. Schmoyer, both of Breinigsville; Bernard D. Bauman, Coopersburg, all of Pa.

[73] Assignee: Air Products and Chemicals, Inc., Allentown, Pa.

[21] Appl. No.: 712,506

[22] Filed: Mar. 18, 1985

Related U.S. Application Data

[63] Continuation of Ser. No. 538,258, Oct. 3, 1983, abandoned.

[51] Int. Cl.[4] ..... B08B 7/04

[52] U.S. Cl. ..... 134/17; 134/34; 134/37; 134/38; 118/70; 241/DIG. 37

[58] Field of Search ..... 118/70; 134/4, 7, 17, 134/37, 38, 34; 241/DIG. 37, 18; 51/319, 322, 320, 321; 427/154, 156

[56] References Cited

U.S. PATENT DOCUMENTS

| | | | |
|---|---|---|---|
| 2,455,514 | 12/1948 | Mead | 51/8 |
| 2,584,031 | 1/1952 | Lander | 51/282 |
| 2,854,360 | 9/1958 | Pajes | 134/15 |
| 3,900,975 | 8/1975 | Lightstone et al. | 51/322 |
| 3,909,289 | 9/1975 | Foucart et al. | 134/2 |
| 3,934,379 | 1/1976 | Braton et al. | 51/319 |
| 4,200,671 | 4/1980 | Krajewski et al. | 134/38 |
| 4,312,156 | 1/1982 | McWhorter | 51/418 |
| 4,355,488 | 10/1982 | Schmitz et al. | 51/319 |
| 4,409,034 | 10/1983 | Williams | 241/DIG. 37 |

FOREIGN PATENT DOCUMENTS

| | | |
|---|---|---|
| 3492 | 2/1976 | Japan . |

*Primary Examiner*—Norman Morgenstern
*Assistant Examiner*—Bernard F. Plantz
*Attorney, Agent, or Firm*—Mark L. Rodgers; E. Eugene Innis; James C. Simmons

[57] ABSTRACT

The removal of paint from a support device for a product in a paint finishing operation is improved by using a support device with a critical surface tension such that paint adheres to the surface, yet readily fractures and debonds when treated with a cryogenic liquid. The paint is then removed by contacting the cryogenically treated support device with a non-metallic, non-silica base solid, gas or liquid with sufficient force to effectively remove the paint.

8 Claims, No Drawings

METHOD OF REMOVING BUILT-UP LAYERS OF ORGANIC COATINGS

This is a continuation of application Ser. No. 538,258, filed 3 Oct. 1983, now abandoned.

TECHNICAL FIELD OF THE INVENTION

The present invention relates to an improvement in the process for the removal of built-up layers of organic coatings.

BACKGROUND OF THE INVENTION

Removing organic coatings, such as paints, from large volumes of racks, hangers or other paint line equipment has been a problem for product finishers. Heavy build-ups of paint can flake off onto the workpiece and prevent a fixture from working properly, and even light build-ups can interfere with the quality of electrostatic painting.

Several techniques have been developed in an attempt to satisfactorily remove these organic coatings. One such technique is to debond or dissolve the organic coating in a chemical solvent bath. Such solvents include methylene chloride and trichloroethane. While these solvents are often effective for debonding the organic coating from the substrate, they generate chemical wastes such as stripping sludges which result in disposal and pollution problems. Additionally, long soaking times are often required, which makes this method undesirable for continuous on-line operations.

Another technique developed is described in U.S. Pat. No. 3,934,379. This method involves applying a liquified, inert gas to the support and/or to the built-up layers of organic material to cause embrittlement of the organic material and lessen the bonded relationship between the support and the built-up layers. The organic layer, while still under cryogenic conditions, is removed from the support by impacting or blasting. This impacting is done by abrasive particles which are blasted onto the surfaces by means of an air blast using a conventional air gun or by means of an airless blast using a centrifugal wheel by which means abrasive particles are drawn radially outwardly at a high speed from radially extending blades mounted on a rotating wheel. Such airless, centrifugal blasting means are well known to those skilled in the art, such as "Wheelabrators" manufactured by Wheelabrator-Frye, Inc. of Mishawaka, Ind. Repeated use of these abrasive particles tends to wear down or deform the hanger, especially where the hanger contains screws, springs, or similar objects. A similar type of method is described in Japanese Patent Application No. 1972-108,687.

While these techniques work well in some instances, they are ineffective for removing coatings thinner than 0.010 inch or for removing coatings comprised of epoxy, urethane and various other types of powder formulations.

BRIEF SUMMARY OF THE INVENTION

The present invention involves an improvement in a process for removing layers of paint built up on a support device for a product during a paint finishing operation. The basic process comprises attaching a product to a support device and painting both the product and a portion of the support device. The product is then removed from the support device, and said support device is cryogenically treated under conditions sufficient to embrittle the paint. After embrittlement has occurred, the paint is removed from the support device. The improvement of the present invention comprises attaching said product to a support device having an exterior low adhesion surface thereon prior to painting, and then removing the paint from the support device by contacting the resultant, cryogenically treated support device with a non-metallic, non-silica base solid, gas or liquid under contacting conditions such that the relative velocity between the support device and said non-metallic, non-silica base solid, gas or liquid is sufficient to remove the paint.

This improved process provides for more efficient paint removal than the prior art processes for the following reasons:

(1) Industrial coatings thinner than 0.01 inch and other coatings such as epoxy and urethane can be effectively removed.

(2) The paint can be lifted off the substrate using a gas or liquid blast or a non-metallic, non-silica base solid, thereby allowing the paint to be removed without damaging the support device.

(3) The coating can be removed at either refrigerated or ambient temperatures following cryogenic treatment.

(4) The process is fast enough to be incorporated directly into automatic, conveyorized painting systems.

DETAILED DESCRIPTION OF THE INVENTION

The present invention is an improved method for removing built-up layers of paint or similar organic coatings from support devices in product finishing operations. The support devices employed in such operations vary widely with the type of product being treated and often have complex geometries. A typical example would be 1/16 to ½ inch diameter steel rods, although much smaller and larger supports are common. The support can be steel, aluminum, plastic or any other material suitable to support the product being treated.

Prior to attaching the product, the support device is pretreated with a specially selected abhesive material. This abhesive material must be able to withstand cryogenic temperatures without cracking or debonding from the support device, and must also be able to withstand rapid temperature changes between about 180° C. and −195° C. The abhesive material must have sufficiently high surface energy to keep the organic coating bound to the fixture to prevent wet paint from dripping on, or cured paint from falling on, the surface of the finished product, yet have a sufficiently low surface energy to allow the organic coating to fracture and debond when treated with a cryogenic liquid.

To help select a pretreatment abhesive material with the desired surface characteristics, a few basic principles of adhesion were addressed. The adhesion (wetability) between a solid (pretreated surface) and a liquid (paint) can be expressed in terms of the contact angle. A drop of liquid placed on a smooth solid forms the goniometric contact angle between the liquid-solid interface and the liquid-vapor interface. The larger the contact angle, the smaller the adhesive forces. When examining the contact angles formed between various liquids and one solid, a plot can be generated showing a relationship between the liquid's surface tension (dyne/cm) and the contact angle. The critical surface tension for that solid is defined as the value on the curve where the contact angle becomes zero. This value represents the liquid that would spread or wet the surface of that solid. Liquids with lower surface tensions will spread. Liquids with higher surface tensions will not spread. By comparing the critical surface tensions of a number of solids, one can predict which solids, i.e., abhesive materials, have the required surface characteristics.

It was found, for purposes of this invention, that the surface material should have a critical surface tension of between about 15 to 25 dyne/cm.

Suitable pretreatment materials can be grouped into three categories: thermoset polymers, polymer-metal combinations and plated metals. From these groups, four preferred abhesive, pretreatment materials were selected:

(1) Endura 202 TM -a nickel plate/fluorinated ethylene propylene copolymer (FEP) applied by Engineered Devices, Inc., Royal Oak, MI;

(2) PTFE/DuPont's Teflon® formulation applied by several licensed applicators;

(3) Silverstone®-DuPont's special PTFE formulation intended especially for cookware and applied by licensed applicators; and (4) No-stick TM -a plasma-sprayed coating consisting of nickel, chromium, and perfluoroalkoxy polymer (PFA) applied by Plasma Spray Coatings, Inc., Waterbury, CT.

All of the above materials have critical surface tensions of or between about 15 to 25 dyne/cm.

The support devices are precoated with the selected abhesive materials by methods known to those skilled in the art, i.e., licensed applicators. The pretreatment is essentially "permanent", in that the abhesive material is not removed or destroyed by subsequent operations.

It should be realized that the surface composition of the support device is the critical factor in the operation of the present invention, and, therefore, if the support device itself inherently has the required surface characteristics, pretreatment with an abhesive material is not necessary. In most instances, however, the support devices do not have the required characteristics and must be precoated.

Subsequent to applying the abhesive material, a product is attached to the support device and an organic coating, such as paint, is applied to both the product and at least a portion of the support device.

After the organic coating has been applied, the product is removed and the support device is cryogenically treated. This is done by either immersing the support device in a cryogenic fluid, or by directly spraying the cryogenic fluid on the support device. Any suitable cryogenic fluid can be used, examples being liquid nitrogen, liquid argon, and liquid carbon dioxide. Coatings bond to the substrate through adhesive and cohesive forces. Cryogenic treatment chills the coating and creates stresses within the coating film by virtue of the differences in the coefficients of thermal expansion between the coating and substrate (support device). These stresses oppose the adhesive and cohesive forces while the cold temperatures embrittle the polymer. Subsequent treatment overcomes the remaining bonding forces and removes the paint chips. Pretreatment materials with surface release characteristics, as described above, reduce these adhesive forces between the organic coating and the substrate and, therefore, improve the effectiveness of the removal process. For example, for thin and tough coatings, cryogenic treatment alone cannot effectively overcome these bonding forces, specifically, the adhesive forces. For the present process, the contact time with the cryogenic fluid depends on the abhesive material used as well as the type of orgnaic coating applied. In many instances, contact times of less than 30 seconds were found to be sufficient.

The organic coating is removed from the support device after cryogenic treatment by contacting the support device with a non-metallic, non-silica base solid, liquid or gas under conditions such that the relative velocity between the support device and the non-metallic solid, liquid or gas is sufficient to remove the paint. As a result of the abhesive precoating material, in most instances, and in the preferred operation of this invention, a fluid blast from an air jet, or agitation of the support device in a fluid bath is sufficient to effectively remove the paint. By eliminating abrasive blasting with a solid material, damage to the support device is virtually eliminated. In some cases, however, as where very thin coats of paint or coatings such as epoxy or urethane are used, solid blasting may be necessary. Even in these instances, however, the abhesive precoat material allows for the use of non-metallic, non-silica base shot to be used where the prior processes either required metal shot or were incapable of removing the paint. Contact time with the solid blast is also greatly reduced by this method, thereby decreasing the amount of damage to the support device.

An additional advantage of the present invention is that, optionally, the paint can be removed at ambient temperatures following the cryogenic treatment, thereby saving energy over the prior art methods where continued cryogenic conditions were required during the removal process. The fast and efficient manner in which the paint is removed allows for the present invention to be operated as a continuous in-line operation.

The following examples serve to provide a better understanding of the claimed invention.

EXAMPLE 1

Six different types of organic coatings were applied to ⅜ inch diameter carbon steel rods. One-third of the rods were pretreated with polytetrafluoroethylene, one-third with a nickel plate/fluorinated ethylene-propylene copolymer and one-third were not pretreated. The organic coatings were applied in thicknesses varying from about 0.001 inch to about 0.02 inch. The coated rods were sprayed with liquid nitrogen for about 3 minutes and then blasted with plastic shot. The minimum coating thickness which could be removed by this method are reported in Table 1 below.

TABLE 1

| Organic Coating | Minimum Thickness of Organic Coating Effectively Removed (inch) A | B | C |
|---|---|---|---|
| Acrylic | >0.01 | ≧0.002 | ≧0.002 |
| Epoxy Primer (formulation A) | No Satisfactory Removal | ≧0.002 | ≧0.002 |
| Epoxy Primer (formulation B) | No Satisfactory Removal | ≧0.002 | ≧0.002 |
| Acrylic Melamine | No Satisfactory Removal | ≧0.002 | ≧0.002 |
| Thermosetting Powder | No Satisfactory Removal | ≧0.002 | ≧0.002 |
| Thermoplastic | >0.002 | ≧0.002 | ≧0.002 |

TABLE 1-continued

| Organic Coating | Minimum Thickness of Organic Coating Effectively Removed (inch) A | B | C |
|---|---|---|---|
| Powder | | | |

A = ⅜ i.d. carbon steel rods.
B = ⅜ i.d. carbon steel rods pretreated with polytetrafluoroethylene.
C = ⅜ i.d. carbon steel rods pretreated with a nickel plate/fluororated ethylene-propylene copolymer.

The above table shows that all of the pretreated steel rods had good organic coating removal down to about 0.002 inch. The untreated steel rods, however, showed either poor or no coating removal with the exception of certain formulations of thermoplastic powder.

EXAMPLE 2

⅜ i.d. carbon steel rods are coated with six different organic coatings. One-half of the rods are pretreated with polytetrafluoroethylene, while the other half are not pretreated. After about 0.01 inch of the organic coating is applied, the rods are dipped in a liquid nitrogen bath for about 2 minutes. The coated rods are then subjected to either a liquid or gas blast for about one minute. The results are reported in Table 2 below.

TABLE 2

| Organic Coating | Coating Removal (Good, Fair, Poor) Liquid Blast: Not Pretreated | Liquid Blast: Pretreated W/Polytetrafluoroethylene | Air Blast: Not Pretreated | Air Blast: Pretreated W/Polytetrafluoroethylene |
|---|---|---|---|---|
| Alkyd-urea | Poor | Good | Poor | Good |
| Acrylic (formulation A) | Poor | Good | Poor | Good |
| Acrylic (formulation B) | Poor | Good | Poor | Good |
| Alkyd-melamine | Poor | Good | Poor | Good |
| Polyester (formulation A) | Poor | Fair | Poor | Fair |
| Polyester (formulation B) | Poor | Good | Poor | Good |

Table 2 indicates that, with the six organic coatings listed, if the supports are pretreated with polytetrafluoroethylene prior to applying the organic coatings, the coatings can be satisfactorily removed using a liquid or gas blast, which does not harm the support. An abrasive solid blast, however, must be used to remove the coatings from the supports which are not treated.

EXAMPLE 3

Two ⅜ i.d. carbon steel rods, one pretreated with polytetrafluoroethylene and one untreated, were coated with a layer of acrylic. A second set of rods, one pretreated as above and the other untreated, were coated with a layer of alkyd-melamine. All four rods were then agitated in a liquid nitrogen bath. The rods pretreated with polytetrafluoroethylene showed almost complete removal of both the acrylic and the alkyd-melamine. The untreated rods, however, showed no paint removal and only slight signs of cracking or debonding.

Having thus described the present invention, what is now deemed appropriate for Letters Patent is set out in the following appended claims.

What is claimed is:

1. A continuous, on-line process for removing layers of paint from a support device for a product in a paint finishing operation, which comprises:

(a) cryogenically treating said support device having a critical surface tension between about 15 to 25 dynes/cm, after a build-up of paint has occurred on said support device, said cryogenic treatment being sufficient to embrittle the paint; and (b) subsequently removing the paint from said cryogenically treated support device using a gas or liquid blast free of any solid, abrasive particles.

2. The process in accordance with claim 1 wherein an abhesive material having a critical surface tension between about 15 to 25 dyne/cm is applied to the support device prior to applying the paint.

3. The process in accordance with claim 1 wherein the build-up of paint on the support device is less than 0.01 inch.

4. The process in accordance with claim 1 wherein the support device is cryogenically treated with a liquid nitrogen spray.

5. The process in accordance with claim 1 wherein the cryogenically treated support device is contacted with an air blast.

6. The process in accordance with claim 5 wherein the paint is selected from the group consisting of: alkyd-urea, acrylic, alkyd-melamine or polyester.

7. The process in accordance with claim 1 which further comprises treating said support device, prior to applying the paint, with a substance selected from the group consisting of: polytetrafluoroethylene; a nickel, chromium and perfluoroalkoxy polymer; or a nickel plate/fluorinated ethylene-propylene copolymer.

8. The process in accordance with claim 1 wherein the paint is removed from the cryogenically treated support device at ambient temperatures.

* * * * *